United States Patent [19]

Dobroski

[11] Patent Number: 4,860,022

[45] Date of Patent: Aug. 22, 1989

[54] SATELLITE DISH ANTENNA SUPPORT RIB APPARATUS

[75] Inventor: Eugene H. Dobroski, Burlington, Iowa

[73] Assignee: Winegard Company, Burlington, Iowa

[21] Appl. No.: 730,683

[22] Filed: May 3, 1985

[51] Int. Cl.[4] ..... H01Q 15/16; H01Q 1/22

[52] U.S. Cl. ..... 343/840; 343/916

[58] Field of Search ..... 343/916, 915, 912, 840; 248/225.1, 223.1–223.4; D14/88–91

[56] References Cited

U.S. PATENT DOCUMENTS

| | | | |
|---|---|---|---|
| D. 285,074 | 8/1986 | Winegard et al. | D14/90 |
| D. 285,685 | 9/1986 | Winegard et al. | D14/90 |
| D. 285,792 | 9/1986 | Winegard et al. | D14/90 |
| 3,234,550 | 2/1966 | Thomas | 343/912 |
| 3,680,144 | 7/1972 | Low et al. | 343/915 |
| 3,970,276 | 7/1976 | Debaigt | 248/225.1 X |
| 4,568,945 | 2/1986 | Winegard et al. | 343/916 |
| 4,578,682 | 3/1986 | Hooper et al. | 343/916 |
| 4,647,943 | 3/1987 | Metcalfe | 343/916 |

FOREIGN PATENT DOCUMENTS

| | | | |
|---|---|---|---|
| 1063713 | 3/1967 | United Kingdom | 248/223.4 |

OTHER PUBLICATIONS

L. P. Inc. Disclosure, Feb. 1981.

*Primary Examiner*—Eugene R. LaRoche
*Assistant Examiner*—Benny T. Lee
*Attorney, Agent, or Firm*—Dorr, Carson, Sloan & Peterson

[57] ABSTRACT

An improved support rib for a satellite dish antenna is disclosed wherein a male side rib selectively engages a female side rib continuously along the longitudinal length of the support rib and wherein the male and female side rib each comprises a continuous engagement device having a lower channel for selectively receiving the side of a parabolic reflective petal and an upper member for one-time flexing downwardly over the lower channel to firmly engage and hold the side of the reflective petal continuously along the longitudinal length of the support rib. When flexed downwardly, the upper member lies in the same plane as the support rib and the petal.

1 Claim, 3 Drawing Sheets

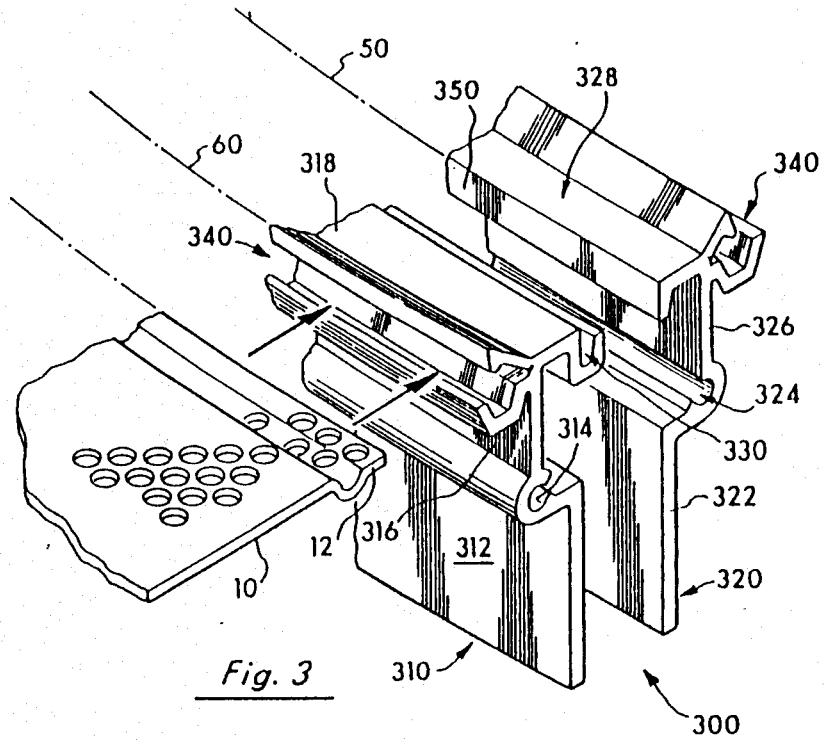
Fig. 3
Fig. 6
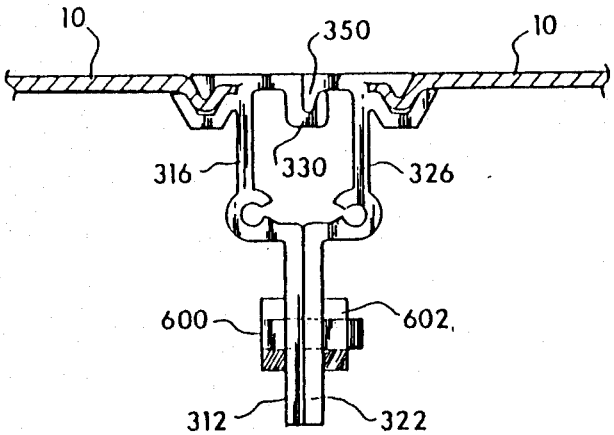

SATELLITE DISH ANTENNA SUPPORT RIB APPARATUS

BACKGROUND OF THE INVENTION

1. Related Applications

This application is related to the commonly assigned applications of:

a. Satellite Dish Antenna Support Split Rim—U.S. Pat. No. Des. 285,685 is issued to John R. Winegard and Keith B. Cowan, b. Satellite Dish Antenna Support Rim—U.S. Pat. No. Des. 285,792 John R. Winegard and Keith B. Cowan, c. Satellite Dish Antenna Outer Rim—U.S. Pat. No. Des. 285,074 issued to John R. Winegard and Keith B. Cowan, and d. Satellite Dish Antenna Apparatus, U.S. Pat. No. 4,568,945 issued to John R. Winegard and Keith B. Cowan.

2. Field of the Invention

This invention relates to the design and construction of a satellite dish antenna having modular parabolic reflector segments. More particularly, it relates to the design of the support rib between the modular segments of a satellite dish antenna.

3. Discussion of the Prior Art

Over the past decade, the use of satellite dish antennas by the consuming public has increased substantially. Two general categories of dish antennas have been involved. The first category contains those dish antennas made of solid material, such as fiberglass, which are molded into a parabolic shape. These antennas generally have high gain and signal reception, but are expensive to ship and have a high wind load when installed. The second category of dish antennas relates to those antennas having a screen-mesh material for the reflective surface. Such antennas are generally assembled in sections and, therefore, are less expensive to ship. They also exhibit low wind load characteristics but have overall lower gain and signal reception. The reason for the lower gain in such screen-mesh antennas is, in primary part, due to their approximation of the true parabolic shape such as through use of a number of linearly shaped segments.

Prior to making an application for the above-identified U.S. Pat. No. 4,568,945 a patentability search was performed. The results of this search are repeated here as follows:

| Inventor | U.S. Pat No. | Issue Date |
|---|---|---|
| E. Gerhard | 2,181,181 | Nov. 28, 1939 |
| S.E. Mautner | 2,471,828 | May 31, 1949 |
| L. Lewin et al. | 2,985,851 | May 23, 1961 |
| D.S. Kennedy | 2,997,712 | Aug. 22, 1961 |
| R.E. Thomas | 3,234,550 | Feb. 8, 1966 |
| E. Kelly | 3,286,270 | Nov. 15, 1966 |
| A.C. Maier | 3,406,404 | Oct. 15, 1968 |
| H.A. Payne | 3,543,278 | Nov. 24, 1970 |
| Rushing et al. | 3,635,547 | Jan. 18, 1972 |
| Quequen | 3,725,945 | Apr. 3, 1973 |
| Taggart, Jr. | 3,832,717 | Aug. 27, 1974 |
| Taggart | 3,971,023 | July 20, 1976 |
| Toshio | 4,169,688 | Oct. 2, 1979 |
| Vines | 4,201,991 | May 6, 1980 |
| Vines | 4,249,184 | Feb. 3, 1981 |
| Davis | 4,257,207 | Mar. 24, 1981 |
| Taggart | 4,268,835 | May 19, 1981 |
| Bannister | 1,604,899 | Dec., 1981 |
| Sayovitz | 4,314,253 | Feb. 2, 1982 |

-continued

| Inventor | U.S. Pat No. | Issue Date |
|---|---|---|
| Palmer et al. | 4,315,265 | Feb. 9, 1982 |
| Hibbard et al. | 4,378,561 | Mar. 29, 1983 |

The 1983 patent to Hibbard (U.S. Pat. No. 4,278,561) relates to a parabolic reflector antenna formed by assembling identical pie-shaped sections of parabolically curved plastic. The sections are preferably glued together along the joints provided along the radial edges.

The patents issued to Taggart (U.S. Pat. Nos. 3,832,717; 3,971,023; and 4,268,835) all relate to parabolic reflectors comprised of generally triangular shaped petals joined together in an edgewise overlapping relationship. In the '023 and '717 patents, an outer rim is provided around the dish antenna to provide outer support. In the '835 patent, a tubular outer segmented rigid rim is provided wherein the opposing ends slidably engage with the next segment. The edgewise overlapping petals are bolted together by means of a plurality of holes.

The 1970 patent issued to Payne (U.S. Pat. No. 3,543,278) also relates to a sectional parabolic reflector wherein individual petal sections are held together by a support molding 17 as shown in FIG. 3 which in turn is bolted to the edges of each section.

The two patents issued to Vines (U.S. Pat. Nos. 4,201,991 and 4,249,184) relate to a parabolic antenna kit comprised of a number of pre-stressed support arms (made from wood) which supports a plurality of screen reflector segments. A tensioning cable engages the outer ends of each support arm an provides sufficient tension, upon assembly, to stress the support arms into a parabolic shape. The parabolic screen is connected to the wood support arms by means of staples or twisted wires.

The patents issued to Sayovitz (U.S. Pat. No. 4,314,253), to Kelly (U.S. Pat. No. 3,286,270), to Maier (U.S. Pat. No. 3,406,404), and to Palmer (U.S. Pat. No. 4,315,265) all relate to collapsible dish antennas of various shapes and configurations. The antennas are assembled as a whole and can be shipped in a collapsed position and at the site can be selectively moved into the operative position.

These patents and other publications are presented and discussed in the aforesaid application. The present invention relates to an improvement in the manner of affixing the pre-formed screen-mesh segments to the support ribs of a satellite dish antenna. The prior art approach is shown in FIG. 1 which corresponds to FIG. 2 of U.S. Pat. No. 4,568,945 identified above. In FIG. 1, the pre-formed screen-mesh 10 of a satellite dish antenna, not shown, engages a support rib 20 comprising an upper rib locking member 30 and a lower locking rib member 40. Both locking members 30 and 40 are made from elongated extruded aluminum pieces and are stretch-formed to follow parabolic curves 50 and 60. The length of each member 30 and 40 is dependent upon the size of the dish antenna, in question.

The upper member 30 is inserted into the lower member 40 by pushing it in the direction of arrow 70. The upper rib member 30 includes a flat upper surface having two downwardly extending prongs 32. Each prong 32 terminates in a hook 34. As shown in FIG. 1, the hooks 34 on each prong points away from the other outwardly directed hook.

The lower rib member 40 has a downwardly extending vertical plate 42 extending the full longitudinal length of the lower support rib 40. This vertical plate 42 provides structural strength for rib 40. At the upper end of the vertical plate 42 are formed two circular cavities 44 also extending the longitudinal length of the lower support rib 40. The circular cavities 44 have an opening directly facing each other. Extending upwardly from each channel 44 are a pair of vertical parallel plates 46 which terminate at their upper ends into outwardly extending horizontal formed channels 48. The ends 12 of the screen-mesh 10 are inserted between the ridges 36 and the channels 48. The upper support member 30 is then forced to engage the lower support member 40 so that the hooks 34 engage the circular cavities 44 the entire longitudinal length of the rib member 20. In this fashion, the rib member 20 provides a continual force along the entire longitudinal length of the support rib 20 to firmly hold the screen-mesh 10.

In FIG. 2, a split rib configuration 100 corresponding to FIG. 7 of U.S. Pat. No. 4,568,945 is set forth having an upper member 110 and a lower split rib member 120. The upper split rib 110 engages the end 12 of the screen-mesh 10 in a fashion similar to that priorly discussed in FIG. 1 for rib member 20. The upper member 110 contains an upper surface having a triangular-shaped elongated ridge 112 extending downwardly at one end. The upper surface is cantilevered from a vertical plate 114 which has an outwardly extending locking lip 116 formed thereon slightly above the mid section of plate 114. The lower split rib member 120 also has a vertical plate 122 which terminates in a substantially circular channel 124 which opens towards the locking lip 116. The upper end of circular channel 124 is connected through a second vertical plate which terminates in a rearwardly extending horizontal channel 126. In operation, the locking ridge 112 firmly engages the end 12 of the screen-mesh 10 and firmly holds it in the horizontal channel 126. As discussed in the afore-referenced patent application, the split rib member 120 shown in FIG. 2 comprises one-half of a symmetrical split rib configuration which is bolted together and which forms the sides of a screen-mesh petal.

As can be observed in FIG. 2, four separate extruded pieces are required to interconnect adjacent petal segments of a satellite dish antenna together. The present invention sets forth a structure which performs the same function as set forth in FIG. 2 with only two extruded pieces thereby substantially reducing manufacturing and inventory costs.

SUMMARY OF INVENTION

A problem in the prior art approach set forth in FIGS. 1 and 2, therefore, is to provide an improved support rib having a minimal number of extruded pieces that can continuously, along the substantial longitudinal length of the support rib, firmly engage the side of a parabolic reflector section wherein, as in the above presented prior art approach, the support rib has an upper reflective surface in the same parabolic plane as the petal and engages the petal at a point under the reflective surface.

The present invention solves this problem by having only two support ribs, a male and a female support rib, wherein each support rib includes a downwardly extending flat plate, a flat reflective surface connected at the upper end of the flat plate, means connected on one end of the rib for continuously engaging the side of the reflected petal, and a male/female locking member connected on the opposing end of the rib for selective engagement to the other side rib for holding the tops of the male and female side ribs firmly together. The device for engaging the side of the reflective petal includes a lower channel connected to the rib which is receptive of the side of the reflective petal and an upper member which is capable of flexing downwardly to firmly hold the side of the reflected petal in the lower channel. The upper member is capable of flexing downwardly only on a one-time flex basis and once in place has sufficient strength to firmly hold the side of the reflective petal in the lower channel. In this position, the upper member has its upper surface lying in the same parabolic plane as the petal and as the support rib.

DESCRIPTION OF THE DRAWING

FIG. 3 is a perspective view of the improved support rib of the present invention;

FIG. 6 is a side planar view of interconnected male and female side rib members of the present invention.

SPECIFICATION

Figure 1:
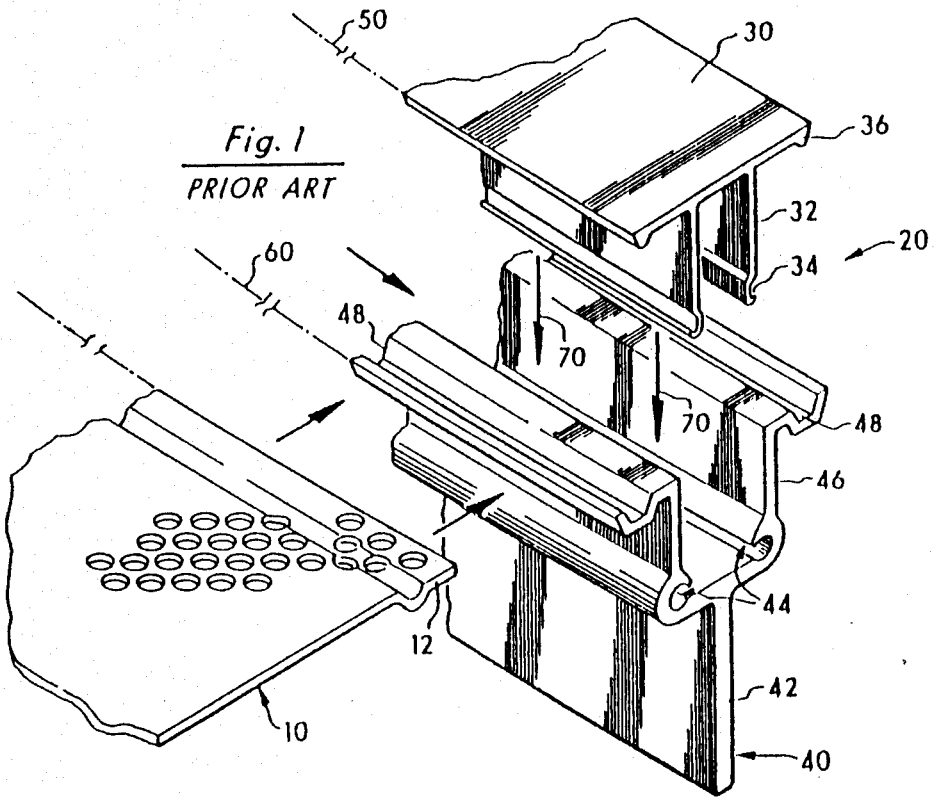
Fig. 1 PRIOR ART
FIG. 1 is a perspective view of a prior art support rib for holding adjacent perforated screen-mesh petals together in a satellite dish antenna (FIG. 1 corresponds to FIG. 2 of U.S. Pat. No. 4,568,945.

In FIG. 3, the details of the improved support rib 300 of the present invention is set forth. The improved support rib 300 includes a female side rib 310 and a male side rib 320 (or a left side rib 310 and a right side rib 320). The female side rib 310 includes a downwardly extending vertical plate 312 terminating at its upper end in a circular cavity 314. A second vertical plate 316 is disposed above the circular cavity 314 and terminates in a horizontally flat reflective surface portion 318. On one end of the surface portion 318 is disposed an upwardly directed female connector 330 and on the opposing end of surface 318 is formed the continuous engagement device 340 of the present invention. The function of the continuous engagement device 340 of the present invention is to engage the side 12 of the screen-mesh 10 and to firmly hold the screen-mesh 10 in continuous engagement with the female side rib 310. It is to be understood, that the continuous engagement device 340 of the present invention is not limited to engaging and holding only perforated screen-mesh material. Any suitable reflector material could also be held.

The male side rib 320 also includes a downwardly extending vertical plate 322 terminating in a circular cavity 324 and further including a second vertical plate 326 disposed above the circular cavity 324. The second vertical plate 326 terminates in a flat reflective surface portion 328. On one side of horizontal portion 328 is disposed a downwardly extending male connector 350 and on the opposing side of the horizontal portion 328 is disposed the continuous engagement device 340 of the present invention. While a female connector 330 and a male connector 350 have been shown other suitable structural connectors between the left side rib 310 and the right side rib 320 could be used.

Figure 4:
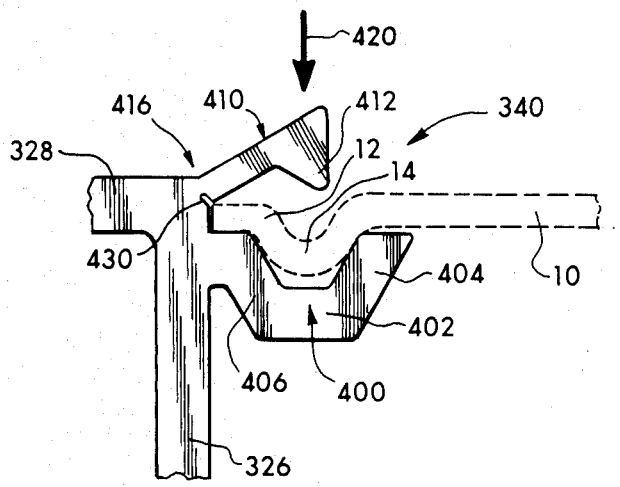
FIG. 4 is a side planar view of the continuous engagement device of the present invention.
Figure 5:
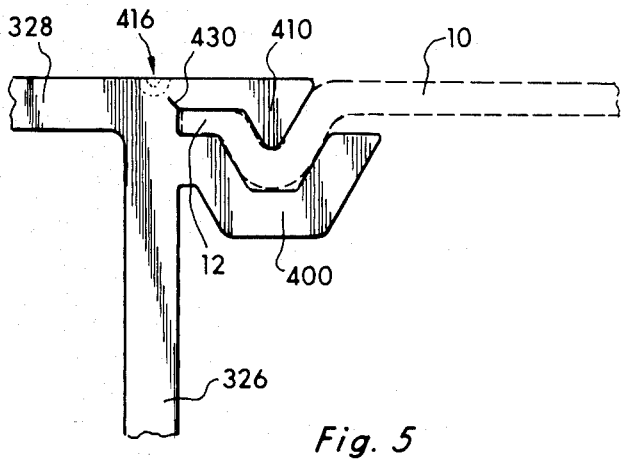
FIG. 5 is a side planar view of the continuous engagement device of the present invention in the closed orientation.

In FIG. 4, the continuous engagement device 340 of the present invention is detailed. The continuous engagement device 340 includes a lower channel 400 opening upwardly and receptive of the curved portion 14 of side 12 of the perforated screen-mesh 10. The channel 400 includes a lower horizontal portion 402 with upwardly and outwardly directed sides 404 and 406. The channel 400 cantilevers outwardly in a horizontal plane from the vertical plate 326. Disposed above channel 400 is a one-time flex member 410 having a downwardly extending ridge or lip 412 at one end. The flex member 410 is capable of movement about region 416 the entire longitudinal length of the rib. The movement occurs when a force is applied in the direction of arrow 420. Opposite region 416 is a formed slot 430 which also extends the longitudinal length of the rib member. When the member 410 is flexed downwardly in the direction of arrow 420 under a suitable force, the ridge 412 firmly engages the side 12 of the perforated screen-member 10, as shown in FIG. 5. When in position, the member 410 lies in the same plane as the upper surface of the perforated screen member 10 and in the same plane as the horizontal surface 328. The slot 430 is compressed into essentially a line and a stress area is established between region 416 and slot 430. However, after the member 410 is flexed downwardly into position, the extruded material comprising the rib member is of sufficient strength that despite the stress and the presence of the slot 430, it firmly engages the side 12 of perforated screen 10 the entire longitudinal length of the rib. The member 410 is designed to flex one time. The male and female support ribs are made from extruded aluminum stock.

In operation, at the factory, a special tool, not shown, applies the force 420 in the direction of arrow. This occurs during the manufacturing of the satellite dish antenna. The performance of this step forms petals or segments of the satellite dish antenna as shown, in FIG. 1, of the above-identified U.S. Patent.

Figure 2:
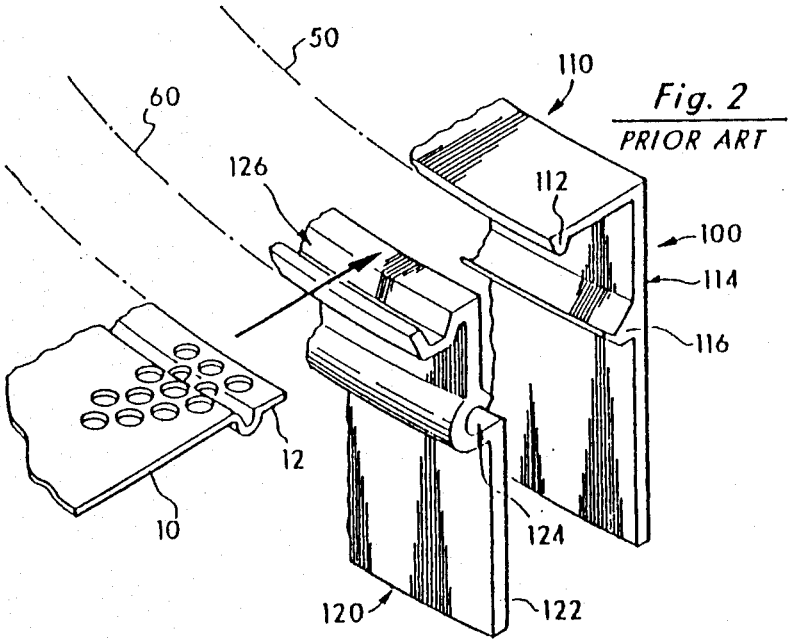
Fig. 2 PRIOR ART
FIG. 2 is a perspective view of a split support rib member for holding adjacent perforated screen-mesh petals together in a satellite dish antenna (this corresponds to FIG. 7 of U.S. Pat. No. 4,568,945.

At the site of installation of the satellite dish antenna, the male and female side ribs 310 and 320 selectively engage each other as shown in FIG. 6. The vertical plates 312 and 322 abut each other and are affixed together at spaced locations by means of a bolt 600 and nut 602. The upper ends of the members 310 and 320 firmly engage each other since the downwardly extending male locking member or connector 350 of rib member 320 engages the female locking member or connector 330 of rib member 310 as shown in FIG. 6. As can be observed, when the flex member is forced downwardly, it cooperates with the flat horizontal surface to form a reflective surface in the same parabolic plane as the perforated screen member 10. It is to be expressly understood that while a male/female engagement has been shown that other structural engagements could be used such as, for example, the prior art engagement 116–124 shown in FIG. 2.

While the preferred embodiment has been set forth with a degree of particularity, it is to be understood that changes and modifications could be made to the construction thereof which would still fall within the teachings of the claimed invention as set forth in the following claims.

I claim:

1. In a satellite dish antenna having a parabolic reflector petal and a support rib for holding the side of said reflector petal when said antenna is assembled; an improvement to said support rib wherein said support rib has an upper reflective surface in the same parabolic plane as said, petal and is capable of engaging, under said upper reflective surface, the side of said petal aligned continuously along the substantial longitudinal length of said support rib, said improved support rib comprising:

a flat reflective surface portion connected to the upper end of said rib, and means connected to one of the aforesaid reflective surface portion for continuously engaging said side reflective petal, said engaging means comprising:

(a) a lower channel connected to said engaging means, said channel comprising a formed upwardly open channel having a lower horizontal portion with upwardly and outwardly directed sides to be receptive of said reflective petal;

(b) an upper member connected to said engaging means, said upper member comprising a downwardly extending ridge angularly positioned over said lower channel; and (c) upper member connecting means for one-time flexing of said upper member downward to firmly hold the aforesaid reflective petal side in said channel by having said ridge engaging and firmly holding said side when said upper member is forced downwardly so that the surface of said upper member is in said parabolic plane, said upper member connecting means further comprising a formed slot at said connection between said upper member and said lower member, wherein said slot compresses under said force.

* * * * *